US007397493B2

(12) United States Patent
Chee et al.

(10) Patent No.: US 7,397,493 B2
(45) Date of Patent: Jul. 8, 2008

(54) LASER PRINTHEAD HAVING A MECHANICAL SKEW CORRECTION MECHANISM

(75) Inventors: Christopher G. Chee, Lexington, KY (US); Paul D. Horrall, Lexington, KY (US); Randall L. Hudson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 329 days.

(21) Appl. No.: 11/234,777

(22) Filed: Sep. 23, 2005

(65) Prior Publication Data

US 2007/0070174 A1 Mar. 29, 2007

(51) Int. Cl.
*B41J 2/435* (2006.01)

(52) U.S. Cl. ..... 347/245; 347/263

(58) Field of Classification Search ..... 347/116, 347/152, 233, 241–242, 245, 256–257, 263
See application file for complete search history.

(56) References Cited

U.S. PATENT DOCUMENTS

| | | | | |
|---|---|---|---|---|
| 4,279,199 | A | 7/1981 | Blanco et al. | |
| 4,570,168 | A | 2/1986 | Sjordal et al. | |
| 4,875,153 | A | 10/1989 | Hons | |
| 4,905,028 | A | 2/1990 | Okubo et al. | |
| 4,926,198 | A | 5/1990 | Barton et al. | |
| 5,050,494 | A | 9/1991 | Goodwin | |
| 5,146,242 | A | 9/1992 | Zielinski | |
| 5,153,608 | A | 10/1992 | Genovese | |
| 5,214,441 | A | 5/1993 | Blanding et al. | |
| 5,237,348 | A | 8/1993 | Blanding et al. | |
| 5,294,943 | A | 3/1994 | Blanding et al. | |
| 5,309,182 | A | 5/1994 | Mama et al. | |
| 5,326,011 | A | 7/1994 | Mager et al. | |
| 5,337,486 | A | 8/1994 | Brechtel | |
| 5,374,993 | A | 12/1994 | Diehl et al. | |
| 5,450,119 | A | 9/1995 | Hinton et al. | |
| 5,485,190 | A | 1/1996 | Koetter et al. | |
| 5,608,430 | A | 3/1997 | Jones et al. | |
| 5,638,106 | A | 6/1997 | Nierescher | |
| 5,737,003 | A | 4/1998 | Moe et al. | |
| 5,764,269 | A | 6/1998 | Takeshita et al. | |
| 5,844,222 | A | 12/1998 | Ackley et al. | |
| 5,946,023 | A | 8/1999 | Blanding | |
| 5,963,240 | A | 10/1999 | Shinohara et al. | |
| 5,970,597 | A | 10/1999 | Bedzyk et al. | |
| 6,052,142 | A | 4/2000 | Bedzyk et al. | |
| 6,055,006 | A | 4/2000 | Murano | |
| 6,281,918 | B1 | 8/2001 | Burdick et al. | |
| 6,396,524 | B1 | 5/2002 | Cooper et al. | |
| 6,429,891 | B1 | 8/2002 | Chee et al. | |
| 6,486,906 | B1 | 11/2002 | Foster et al. | |
| 6,535,236 | B1 * | 3/2003 | Chappel et al. | 347/263 |
| 6,600,504 | B2 * | 7/2003 | Okugawa et al. | 347/263 |

* cited by examiner

*Primary Examiner*—Hai C Pham
(74) *Attorney, Agent, or Firm*—Stevens & Showalter, LLP

(57) ABSTRACT

An imaging apparatus is provided including a frame having a portion upon which a printhead is adapted to be mounted. The printhead may include a housing including a main body, at least one flexible mounting beam extending from the main body, and at least one structural member coupled to the at least one flexible mounting beam. The printhead may also include a skew correction mechanism mounted to the printhead housing. The skew correction mechanism may include an adjustment member capable of engaging at least one surface on the printhead housing so as to adjust the position of the printhead housing relative to the frame portion.

18 Claims, 8 Drawing Sheets

LASER PRINTHEAD HAVING A MECHANICAL SKEW CORRECTION MECHANISM

1. FIELD OF THE INVENTION

The present invention relates to a mechanical skew correction mechanism for adjusting the position of a printhead housing main body relative to a portion of a printer frame.

2. DESCRIPTION OF RELATED ART

Multi-laser color printers may comprise a plurality of printheads each including a housing containing a laser diode and a rotating polygonal mirror for generating a corresponding scanning laser beam for creating a latent image on a corresponding photoconductive drum. Each latent image is developed and may be transferred to an intermediate transfer belt so as to form a composite toner image, which is later transferred to a substrate. The substrate with the toner image is subsequently passed through a fuser where heat is applied to melt the toner and fuse it to the substrate. Each color image needs to be accurately registered relative to all of the other color images to ensure that print quality is satisfactory.

Process direction misregistration that varies in magnitude along a single scan line is commonly referred to as skew and is typically caused by a misalignment of the scanning laser beam. Scan line skew may be adjusted by mechanically rotating the printhead housing about a pivot point. For example, U.S. Pat. No. 6,281,918 B1 discloses a printhead skew adjustment mechanism for correcting printhead skew. The skew adjustment mechanism comprises a cam which engages a cam backstop mounted to a printer frame and further engages a single cam follower surface of a base of the printhead. Such a skew adjustment mechanism has limitations as only a single cam follower surface of the printhead base is capable of being engaged for movement.

U.S. Pat. No. 6,429,891 B1 discloses a printhead fine adjustment mechanism comprising an adjustment frame and an engagement shaft. The engagement shaft can be rotated so as to move one of its opposing engagement ends into contact with one of two resilient elongate members of a printhead housing. The fine adjustment mechanism must be directly coupled to the printer frame after the position of the printhead housing is adjusted during a coarse skew adjustment operation. The required secondary operation of coupling the fine adjustment mechanism to the printer frame after effecting coarse skew adjustment is a time consuming operation.

Alternative mechanical skew correction mechanisms are desired.

SUMMARY OF THE INVENTION

In accordance with a first aspect of the present invention, an imaging apparatus is provided comprising a frame having a portion upon which a printhead is adapted to be mounted. The printhead may comprise a housing including a main body, at least one flexible mounting beam extending from the main body, and at least one structural member coupled to the at least one flexible mounting beam. The printhead may also comprise a skew correction mechanism mounted solely to the printhead housing. The skew correction mechanism may include an adjustment member capable of engaging at least one surface on the printhead housing main body so as to adjust the position of the printhead housing main body relative to the frame portion.

The at least one surface on the printhead housing main body may comprise first and second surfaces on the printhead housing main body such that the adjustment member is capable of engaging the first and second surfaces on the printhead housing main body.

The at least one flexible mounting beam may comprise at least first and second flexible mounting beams extending from the main body and wherein the at least one structural member may comprise a first substantially rigid structural member coupled to the first and second flexible mounting beams. The at least one flexible mounting beam may further comprise third and fourth flexible mounting beams extending from the main body and wherein the at least one structural member may further comprise a second substantially rigid structural member coupled to the third and fourth flexible mounting beams.

Each of the first and second substantially rigid structural members may comprise at least one mounting feature for fixing the printhead housing to the frame portion. The mounting feature may have an enlarged mounting slot through which a fastener extends such that the fastener may be lightly secured to the frame portion to allow the printhead housing to be subsequently adjusted relative to the frame portion.

The adjustment member of the skew correction mechanism may comprise a camshaft and first and second cam lobes coupled to the camshaft. The first cam lobe is adapted to engage the first surface on the printhead housing main body and the second cam lobe is adapted to engage the second surface on the printhead housing main body.

The first and second surfaces on the printhead housing main body may be defined by first and second cam follower surfaces on the printhead housing main body.

The first and second cam lobes may be axially spaced apart along the camshaft. Further, each of the first and second cam lobes may extend through a maximum angle falling within a range of about 10 degrees to about 180 degrees.

The skew correction mechanism may further comprise a detent wheel coupled to the camshaft such that the camshaft rotates with the detent wheel.

The skew correction mechanism may further comprise a first camshaft support mounted to the first substantially rigid structural member. The first camshaft support may include a pawl including an engagement member for engaging one of a plurality of recesses provided in the detent wheel. The skew correction mechanism may further comprise a second camshaft support on the first substantially rigid structural member for receiving an end portion of the camshaft.

In accordance with a second aspect of the present invention, an imaging apparatus is provided comprising a frame having a portion upon which a printhead is adapted to be mounted. The printhead may comprise a housing including a main body, at least one flexible mounting beam extending from the main body, and at least one structural member coupled to the at least one flexible mounting beam. The printhead may further comprise a skew correction mechanism associated with the printhead housing. The skew correction mechanism may include an adjustment member capable of engaging first and second surfaces on the printhead housing main body so as to adjust the position of the printhead housing main body relative to the frame portion.

In accordance with a third aspect of the present invention, an imaging apparatus is provided comprising a frame having a portion upon which a printhead is adapted to be mounted. The printhead may comprise a housing including a main body, at least one flexible mounting beam extending from the main body, and at least one structural member coupled to the at least one flexible mounting beam. The printhead may further comprise a skew correction mechanism associated with the printhead housing. The skew correction mechanism may include an adjustment member having first and second camming members capable of engaging first and second cam follower surfaces on the printhead housing main body so as to adjust the position of the printhead housing main body relative to the frame portion.

The adjustment member of the skew correction mechanism may comprise a camshaft and first and second cam lobes defined by the first and second camming members.

DETAILED DESCRIPTION

Figure 1:
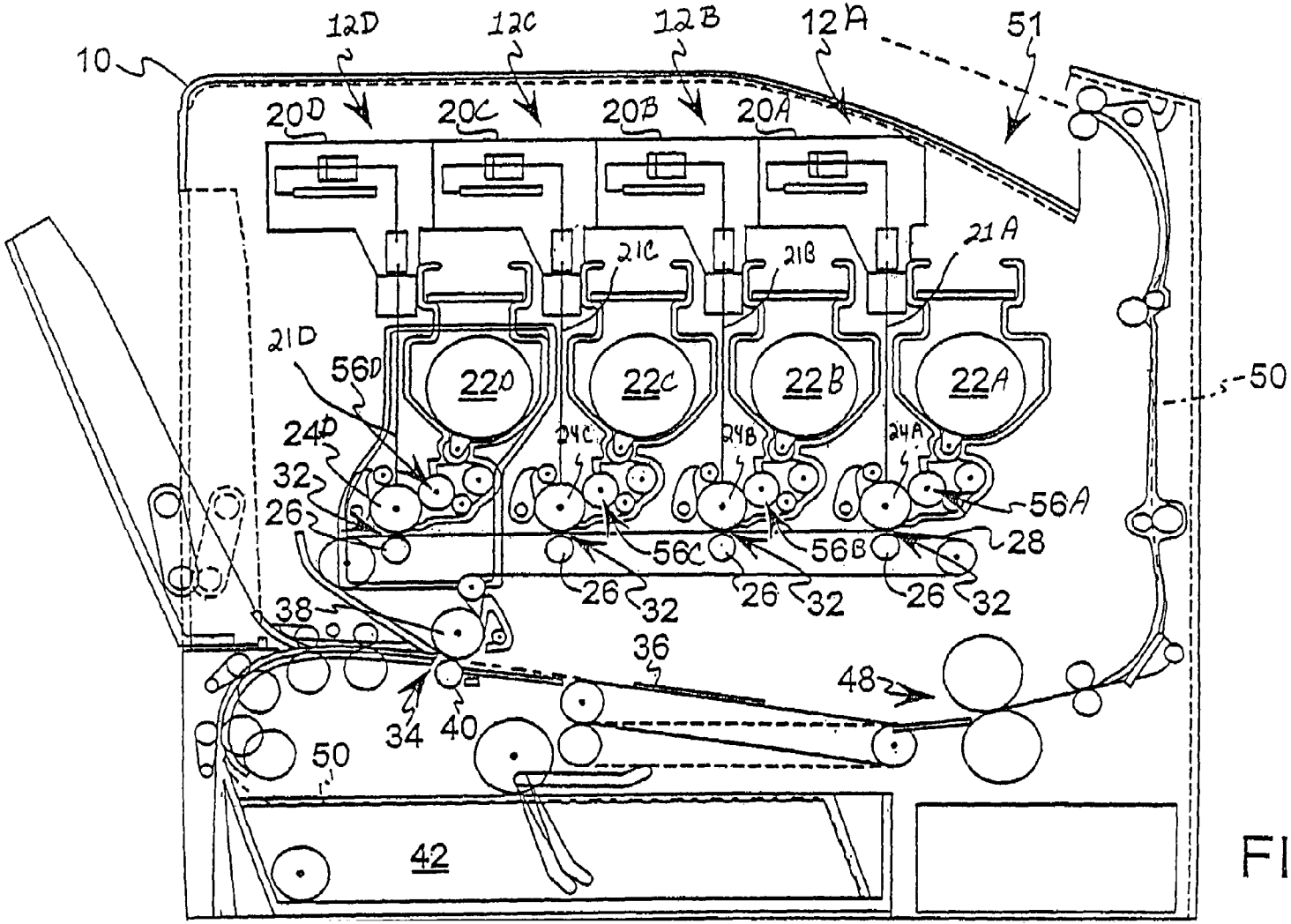
FIG. 1 is a schematic side view of a printer having a plurality of printheads, each of which may be provided with a mechanical skew correction mechanism constructed in accordance with the present invention.

Referring to FIG. 1, a color electrophotographic (EP) printer 10 is illustrated including four image forming stations 12A-12D for creating yellow (Y), cyan (C), magenta (M) and black (K) toner images. Each of the image forming stations 12A-12D includes a corresponding laser printhead 20A-20D, toner supply 22A-22D and developing assembly 56A-56D. Each image forming station 12A-12D also includes a rotatable photoconductive (PC) drum 24A-24D. A uniform charge is provided on each PC drum 24A-24D, which is selectively dissipated by a scanning laser beam 21A-21D generated by a corresponding printhead 20A-20D, such that a latent image is formed on the PC drum 24A-24D. The latent image is then developed during an image development process via a corresponding toner supply 22A-22D and developing assembly 56A-56D, in which electrically charged toner particles adhere to the discharged areas on the PC drum to form a toned image thereon. An electrically biased transfer roller 26 opposes each PC drum 24A-24D. An intermediate transfer member (ITM) belt 28 travels in an endless loop and passes through a nip defined between each PC drum 24A-24D and a corresponding transfer roller 26. The toner image developed on each PC drum 24A-24D is transferred during a first transfer operation to the ITM belt 28 by an electrically biased roll transfer operation. The four PC drums 24A-24D and corresponding transfer rollers 26 constitute first image transfer stations 32.

At a second image transfer station 34, a composite toner image, i.e., the yellow (Y), cyan (C), magenta (M) and black (K) toner images combined, is transferred from the ITM belt 28 to a substrate 36, see FIG. 1. The second image transfer station 34 includes a backup roller 38, on the inside of the ITM belt 28, and a transfer roller 40, positioned opposite the backup roller 38. Substrates 36, such as paper, cardstock, labels, or transparencies, are fed from a substrate supply 42 to the second image transfer station 34 so as to be in registration with the composite toner image on the ITM belt 28. The composite image is then transferred from the ITM belt 28 to the substrate 36. Thereafter, the toned substrate 36 passes through fuser assembly 48, where the toner image is fused to the substrate 36. The substrate 36 including the fused toner image continues along a paper path 50 until it exits the printer 10 into an exit tray 51.

The paper path 50 taken by the substrates 36 in the printer 10 is illustrated schematically by a dashed line in FIG. 1. It will be appreciated that other printer configurations having different paper paths may be used. Further, one or more additional media supplies or trays, including manually fed media trays, may be provided.

If it is determined that one or more of printheads 20A-20D are identified as being skewed, the printhead orientation can be adjusted using the printhead skew correction mechanism 70 of the present invention, as is more fully described below.

Each of the printheads 20A-20D is substantially identical in structure. Accordingly, to simplify the discussion and for ease of understanding the invention, only the structure of printhead 20A will be described in detail below in relation to FIGS. 2-9 and FIGS. 3A and 8A. However, it is to be understood that the discussion that follows with respect to printhead 20A also applies to each of printheads 20B-20D. As discussed below, one of the printheads 20B-20D may comprise a reference printhead. As also discussed below, the reference printhead may not be provided with a skew correction mechanism 70.

Referring to FIGS. 2, 3, 6-9, the printhead 20A comprises a housing 60 including a main body 62. The main body 62 houses a laser diode (not shown), a rotating polygonal mirror (not shown), pre-scan optics (not shown) and post-scan optics (not shown). The laser diode is modulated according to a video signal corresponding to it color image plane. The laser beam passes through the pre-scan optics, is reflected off the polygonal mirror, passes through the post-scan optics and exits the printhead housing main body 62 through a lower portion 62A of the main body 62 such that the corresponding laser beam 21A is moved along a scan path 121A, see FIG. 2, on a corresponding one of the PC drums 20A-20D (a PC drum is not illustrated in FIG. 2). A cover 63 is fastened to the main body 62 to prevent dust and the like from reaching the pre-scan and post-scan optics as well as the polygonal mirror.

Extending from and integral with a first section 62B of the printhead housing main body 62 are first and second flexible mounting beams 64A and 64B, see FIGS. 2, 3, 6-9. A first substantially rigid structural member 65 (not shown in FIGS. 7 and 8) is integrally formed with the first and second flexible mounting beams 64A and 64B. Extending from and integral with a second section 62C of the main body 62 are third and fourth flexible mounting beams 64C and 64D, see FIGS. 2 and 3. A second substantially rigid structural member 66 is integrally formed with the third and fourth flexible mounting beams 64C and 64D. As will be discussed more explicitly below, the first and second structural members 65 and 66 are rigidly mounted to a frame portion of a main printer frame. The geometry of the first, second, third and fourth flexible mounting beams 64A-64D is such that the beams 64A-64D are relatively flexible in a process direction, indicated by arrow A in FIG. 3, so as to allow movement of the main body 62 relative to the first and second structural members 65 and 66 and the printer frame.

As noted above, the printer 10 comprises a main frame to which the printheads 20A-20D are mounted. More specifically, each printhead 20A-20D is mounted to a corresponding frame portion or mounting bracket 120, see FIGS. 2 and 3, where the printhead 20A is shown mounted to frame portion 120. As illustrated in FIG. 3A, the frame portion 120 comprises a substantially planar upper surface 120A having a center opening 120B. Three tapped holes 120C-120E are provided in the frame portion 120.

Figure 2:
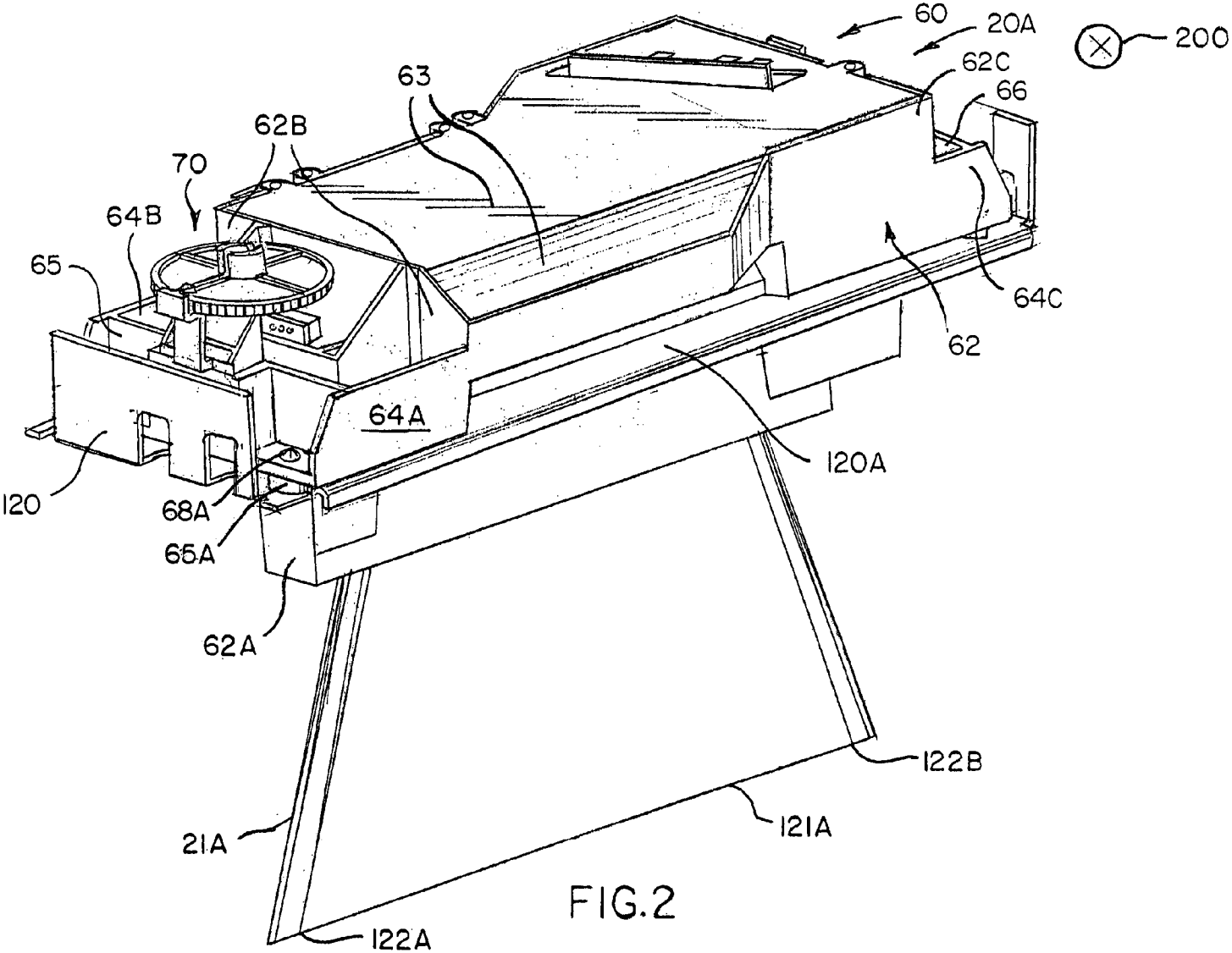
FIG. 2 is a perspective view of one of the printheads illustrated in FIG. 1 coupled to a printer frame portion.
Figure 3:
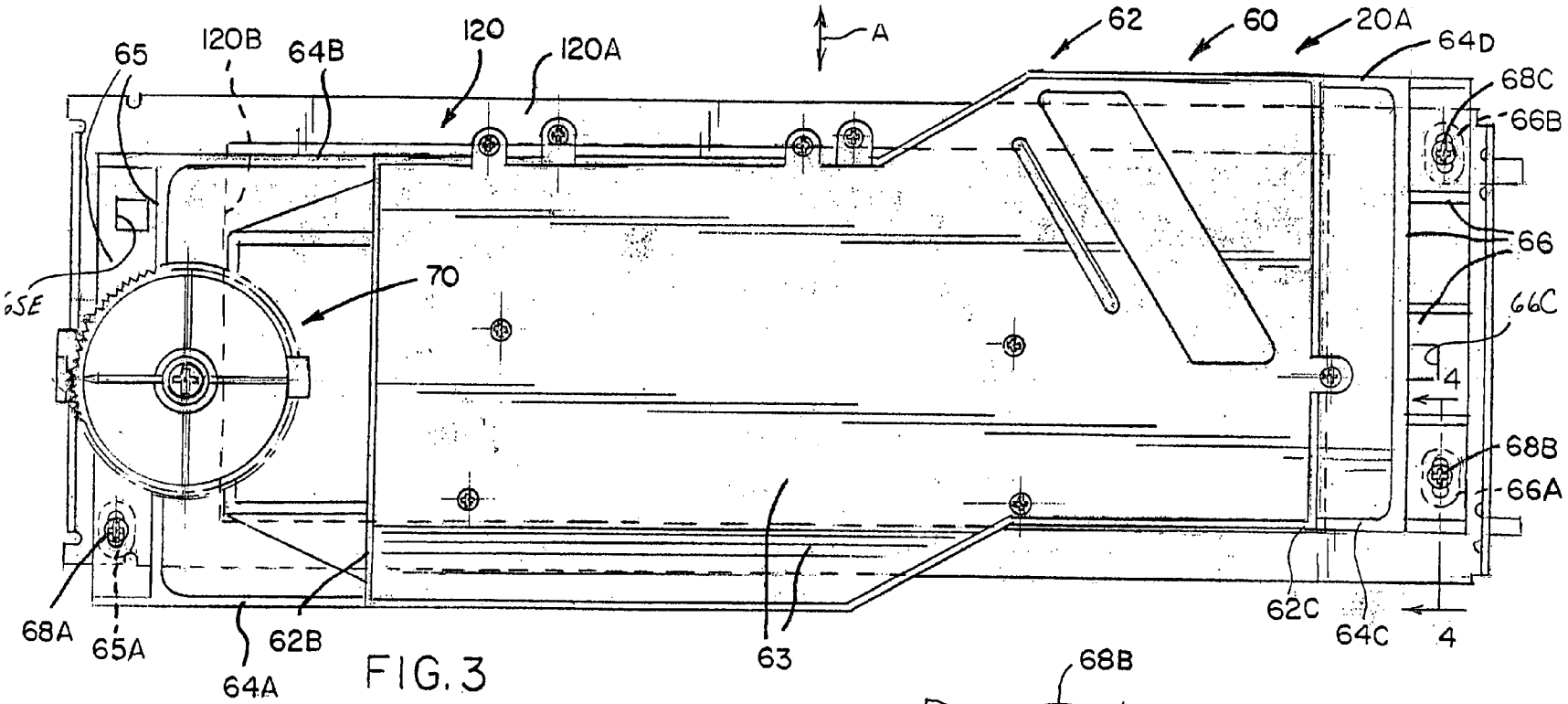
FIG. 3 is a top view of the printhead of FIG. 2.
Figure 4:
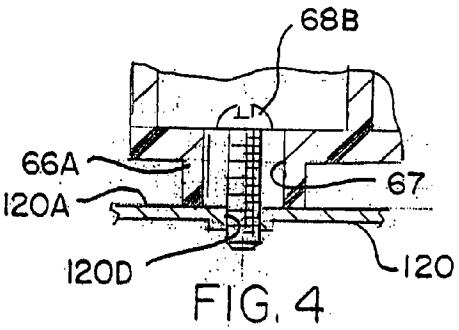
FIG. 4 is a view taken along view line 4-4 in FIG. 3.
Figure 3A:
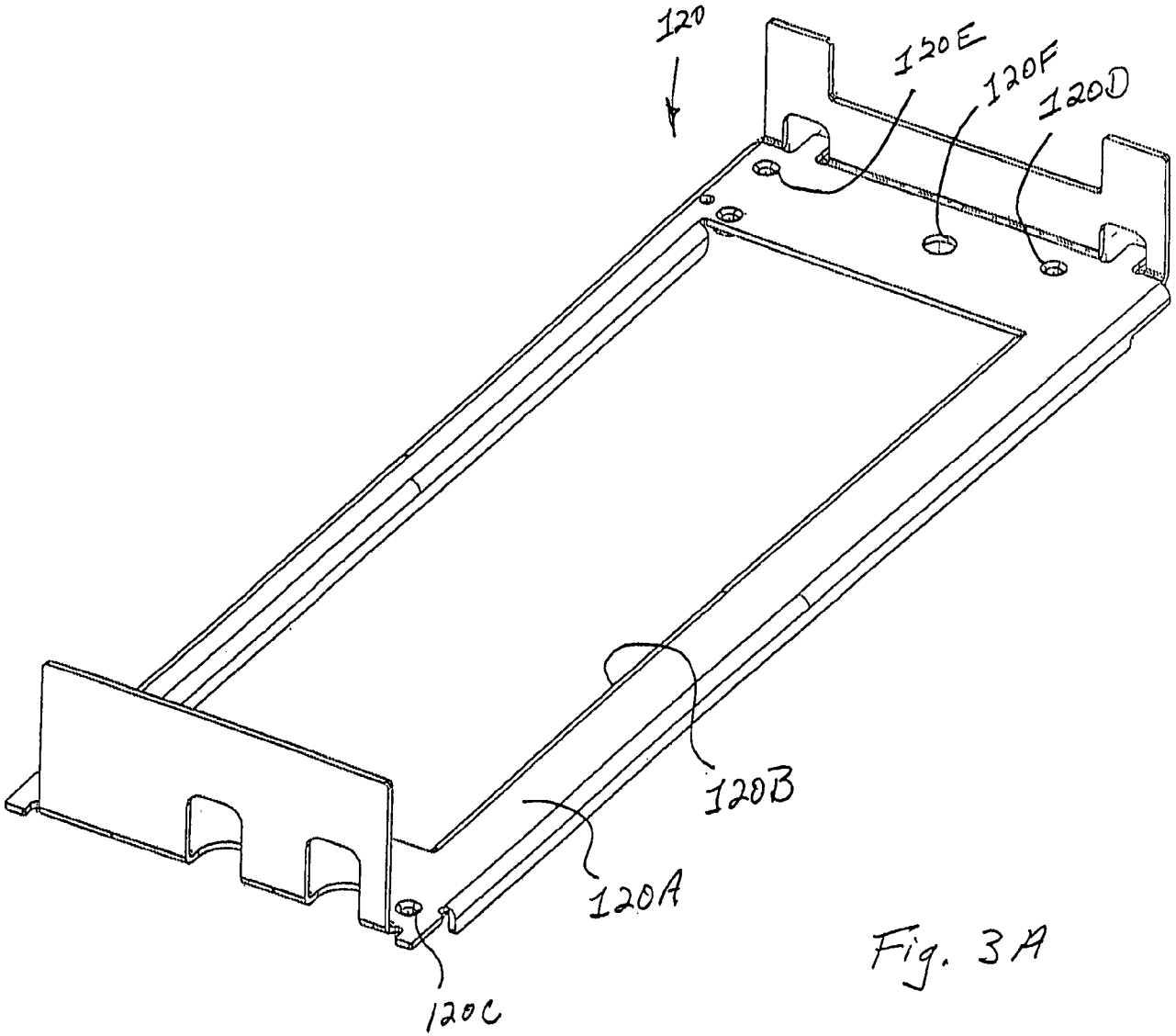
FIG. 3A is a perspective view of the printer frame portion illustrated in FIGS. 2 and 3 without a printhead mounted thereto.

In the illustrated embodiment, the first rigid structural member 65 is provided with a single mounting feature or boss 65A, see FIGS. 2 and 3. The second rigid structural member 66 is provided with second and third mounting features or bosses 66A and 66B, see FIG. 3. When assembling the printhead 20A to the frame portion 120, the lower portion 62A of the main body 62 is inserted through frame portion center opening 120B and the mounting features 65A, 66A and 66B are positioned so as to rest on the frame portion planar upper surface 120A, see FIGS. 3 and 4. Preferably, the mounting features 65A, 66A and 66B are positioned directly over the tapped holes 120C-120E provided in the frame portion 120. Each mounting feature 65A, 66A, 66B is provided with an enlarged mounting slot 67 through which a corresponding fastener 68A-68C extends, see FIGS. 3, 4 and 9. Each fastener 68A-68C is received in a corresponding one of the tapped holes 120C-120E so as couple the printhead housing 60 to the frame portion 120.

Figure 7:
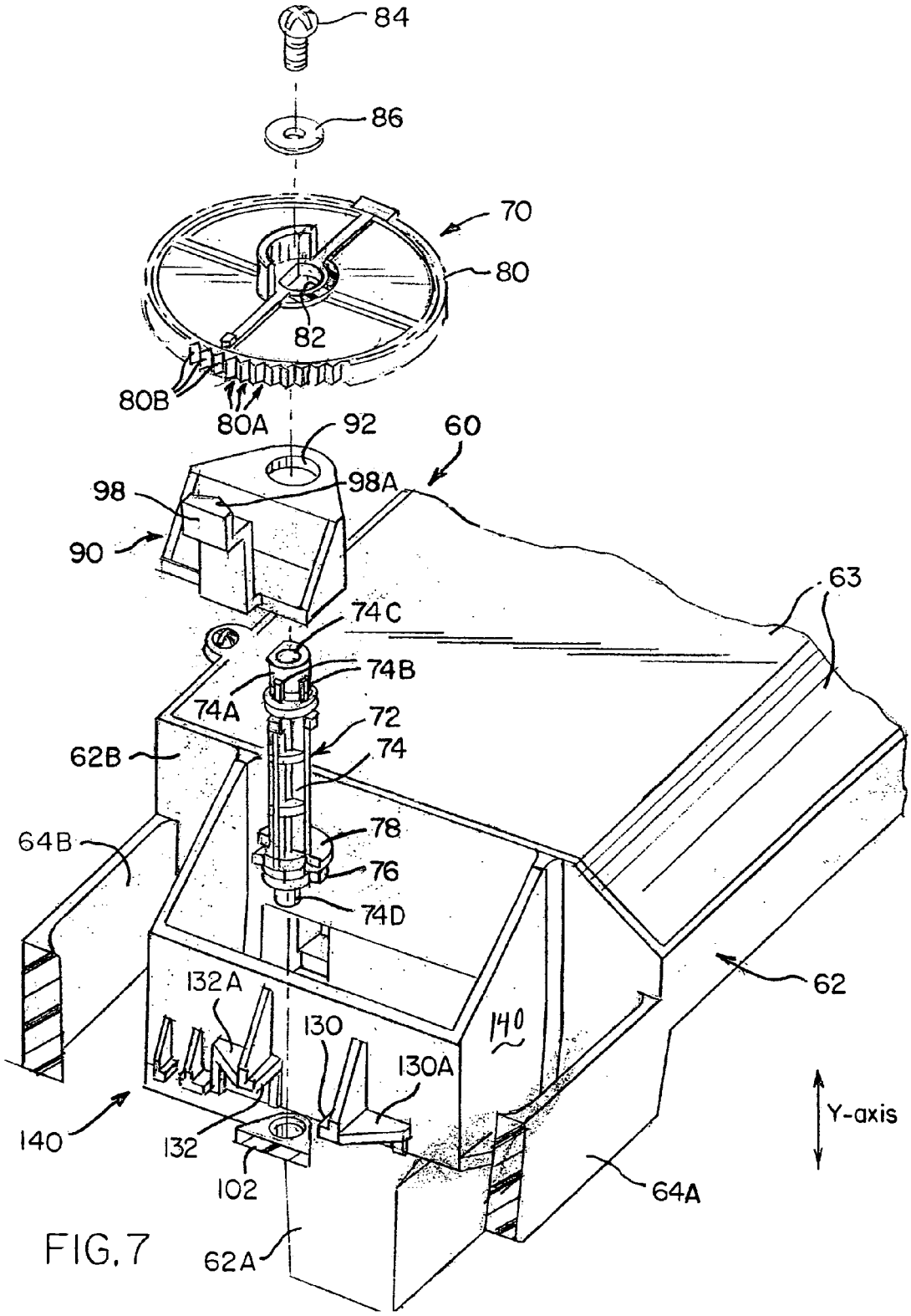
FIG. 7 is a perspective view partially in section of a portion of the printhead of FIG. 2 illustrating the first and second flexible mounting beams, the first section of the printhead housing main body and the control card support structure and further illustrating in exploded form the camshaft, detent wheel and first camshaft support and with the first substantially rigid structural member removed.

The printhead 20A further comprises the skew correction mechanism 70 which, in the illustrated embodiment, is mounted solely to the printhead housing 60. The skew correction mechanism 70 includes an adjustment member 72 comprising a camshaft 74 and first and second cam lobes 76 and 78 formed integral with the camshaft 74, see FIGS. 5 and 7. The skew correction mechanism 70 further comprises a detent wheel 80 and a first camshaft support 90. As illustrated in FIG. 7, the first camshaft support 90 includes an opening 92 through which a first end 74A of the camshaft 74 extends prior to passing through a center opening 82 in the detent wheel 80. A plurality of stop members 74B provided on the camshaft 74 limit the distance that the camshaft first end 74A extends into the center opening 82 in the detent wheel 80. The camshaft 74 includes an opening 74C in its first end 74A. A self-tapping screw 84 passes through a washer 86, then extends through the detent wheel center opening 82 prior to being received in the opening 74C in the camshaft 74 so as to couple the detent wheel 80 to the camshaft 74 such that the detent wheel 80 rotates with the camshaft 74.

Figure 5:
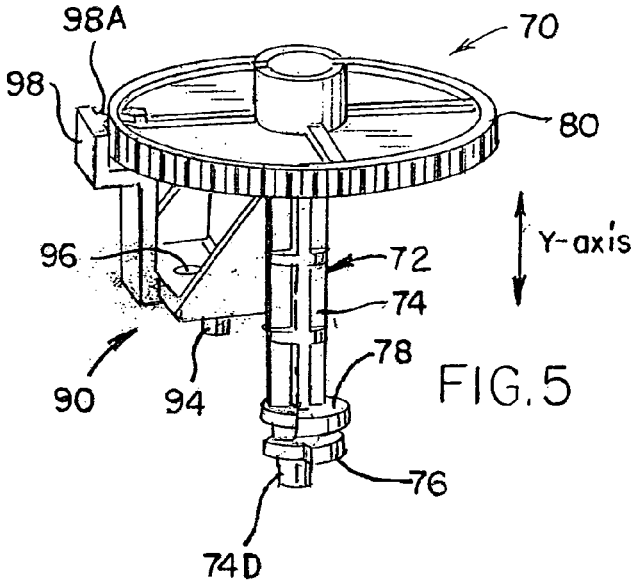
FIG. 5 is a perspective view of a camshaft, detent wheel and first camshaft support.
Figure 6:
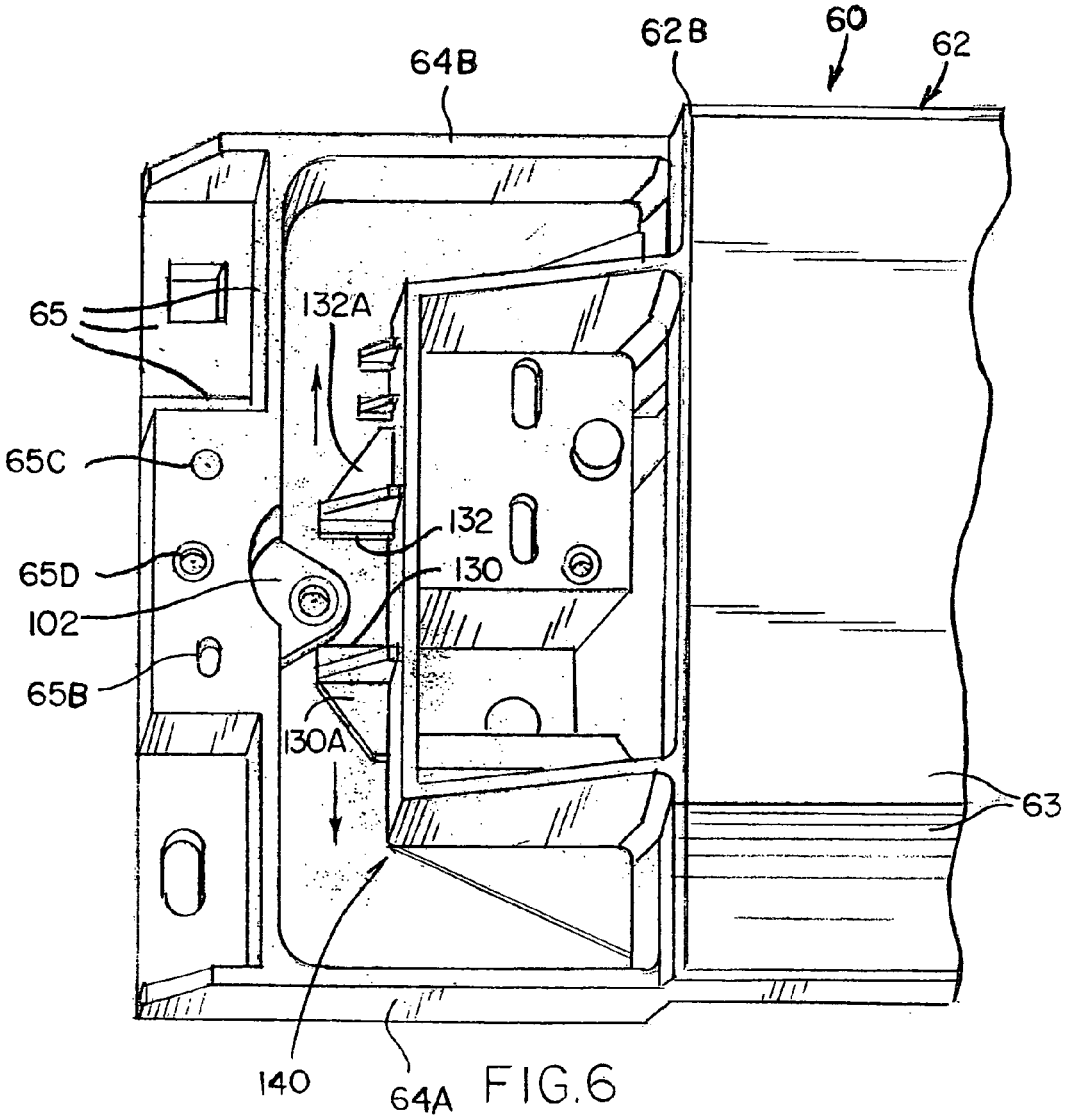
FIG. 6 is a perspective view of a portion of the printhead of FIG. 2 including first and second flexible mounting beams, a first substantially rigid structural member, a first section of the printhead housing main body and a control card support structure and with the camshaft, detent wheel and first camshaft support removed.
Figure 8:
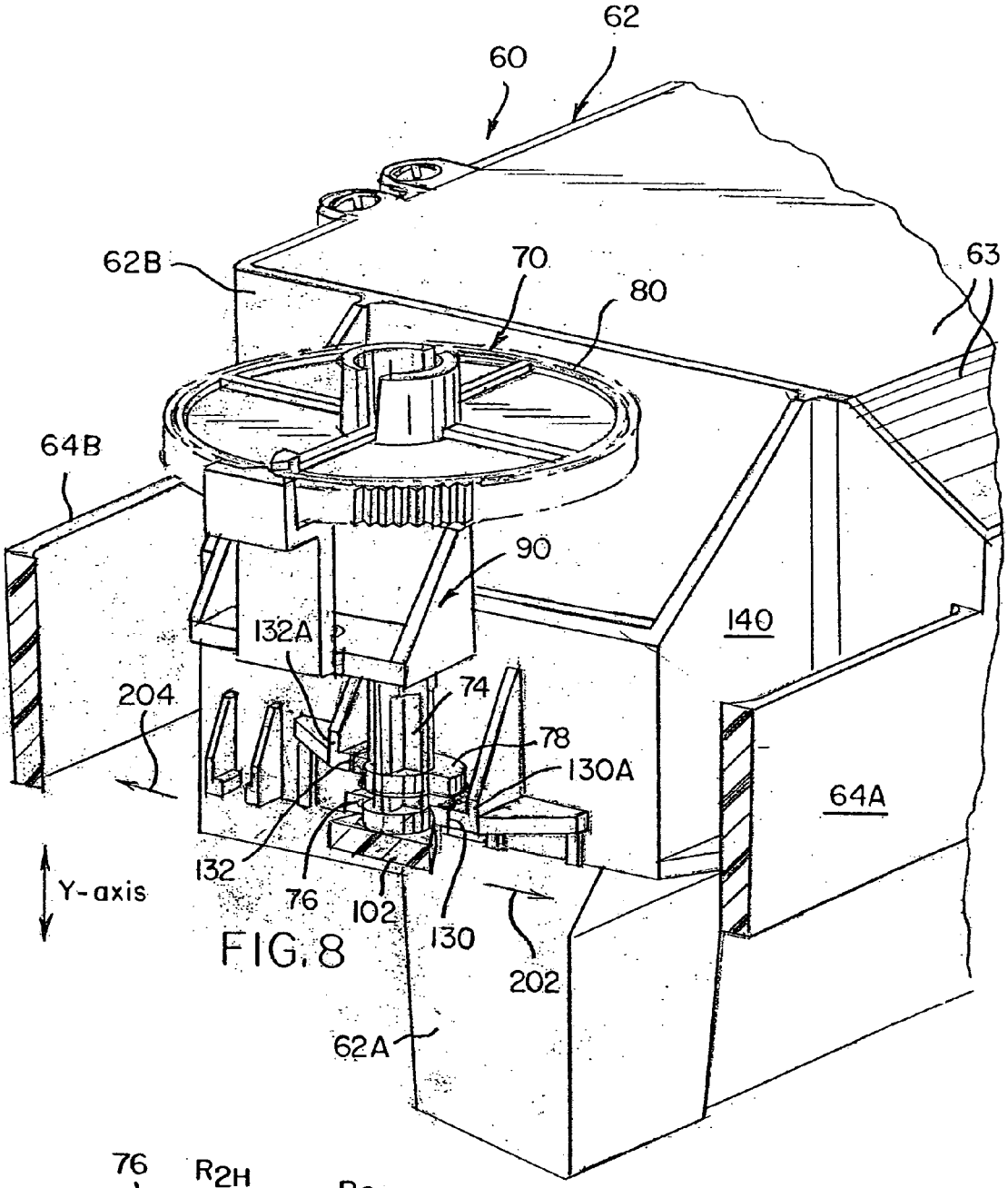
FIG. 8 is a perspective view of a portion of the printhead of FIG. 2 illustrating the first and second flexible mounting beams, the first section of the printhead housing main body, the control card support structure, the camshaft, the detent wheel and the first camshaft support and with the first substantially rigid structural member removed.
Figure 8A:
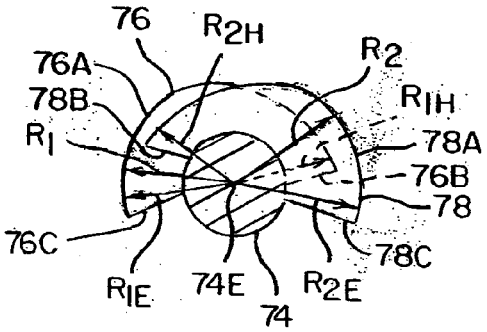
FIG. 8A is a view partially in section of the camshaft and the first and second cam lobes formed on the camshaft.
Figure 9:
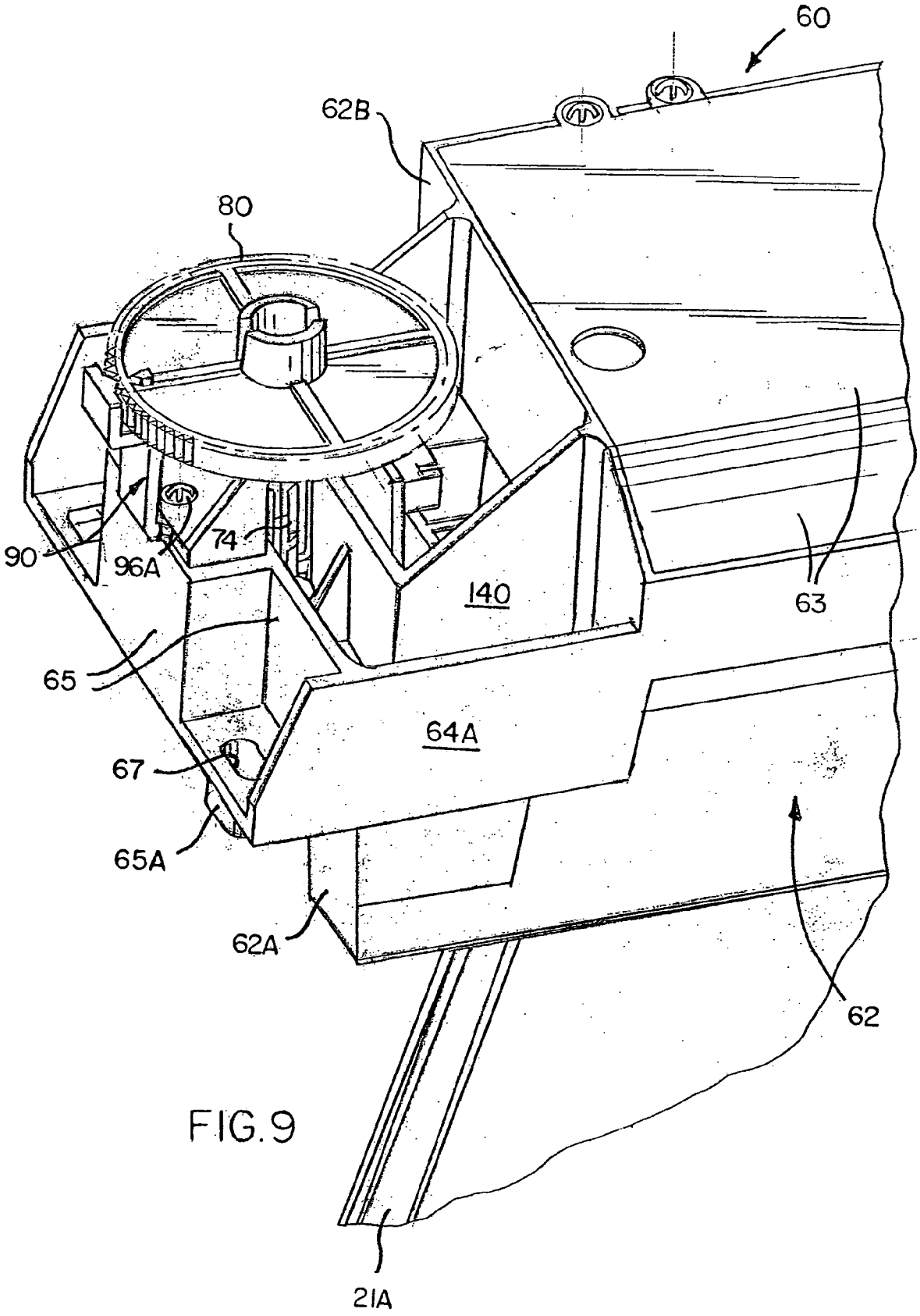
FIG. 9 is a perspective view of a portion of the printhead of FIG. 2 illustrating the first and second flexible mounting beams, the first section of the printhead housing main body, the control card support structure, the first substantially rigid structural member, the camshaft, the detent wheel and the first camshaft support.

To mount the skew correction mechanism 70 to the printhead housing 60, a second end 74D of the camshaft 74 is inserted into a second camshaft support 102 formed integrally with the first substantially rigid structural member 65, see FIGS. 6-8. In FIGS. 7 and 8, the first structural member 65 is cut-away to facilitate visibility of the second camshaft support 102. The first camshaft support 90 is then coupled to the first structural member 65. The first support 90 is provided with first and second pins (only first pin 94 is illustrated in FIG. 5). The first and second pins are received in corresponding first and second openings 65B and 65C provided in the first structural member 65, see FIG. 6. First opening 65B is elongated to allow for tolerances with regard to the distance between the first and second pins. A screw 96A passes through a center opening 96 provided in the first camshaft support 90 and is received in an opening 65D in the first structural member 65, see FIGS. 5, 6 and 9.

The first camshaft support 90 includes a flexible pawl 98 having a recess-engagement member 98A for engaging one of a plurality of recesses 80A provided between pairs of adjacent teeth 80B circumferentially located about the detent wheel 80, see FIGS. 5 and 7. As will be discussed further below, an operator may rotate the detent wheel 80 so as to adjust the position of the printhead housing main body 62 relative to the frame portion 120. Once the main body 62 has been moved to a desired location relative to the frame portion 120, the recess-engagement member 98A releasably locks the detent wheel 80 in position by engaging a recess 80A in the detent wheel 80 corresponding to the selected position of the main body 62. The recess-engagement member 98A also provides audible feedback during rotation of the detent wheel 80.

In the illustrated embodiment, the first and second cam lobes 76 and 78 are axially spaced apart along the camshaft 74, i.e., along a Y-axis as viewed in FIG. 5. When the skew correction mechanism 70 has been mounted to the printhead housing 60, the first cam lobe 76 is positioned adjacent to or slightly in contact with a first cam follower surface 130 on a first cam follower extension 130A, see FIG. 8. The cam follower extension 130A is formed integral with an Hsync control card support structure 140. Located within the printhead housing 60 is a horizontal sync (Hsync) sensor (not shown). Each time a new facet on the rotating polygonal mirror intercepts the laser beam emitted from the laser diode, the laser beam begins scanning a new line across a corresponding PC drum 24A. A mirror is coupled to the printhead housing 60 and located such that it reflects the beam onto the Hsync sensor just before the beam begins scanning across the PC drum. The Hsync sensor senses the beam just prior to the beam writing or imaging a line of print elements (PELs) or dots on the PC drum. The Hsync control card receives signals generated by the Hsync sensor. The Hsync control card is not illustrated.

When the skew correction mechanism 70 has been mounted to the printhead housing 60, the second cam lobe 78 is positioned adjacent to or slightly in contact with a second cam follower surface 132 on a second cam follower extension 132A, wherein the extension 132A is also formed integral with the support structure 140. The first and second cam follower surfaces 130 and 132 are vertically spaced apart along a Y axis, see FIGS. 7 and 8, to correspond to the vertically spaced apart cam lobes 76 and 78. As will be discussed more explicitly below, an operator may rotate the detent wheel 80 in a first or a second direction causing one of the cam lobes 76 to apply a force to a corresponding cam follower surface 130, 132 to effect movement of the printhead housing main body 62 relative to the rigid structural members 65 and 66 and the frame portion 120. The control card support structure 140 is formed integral with the first section 62B of the printhead housing main body 62 so as to form part of the main body 62. The support structure 140 has a geometry such that forces applied by a cam lobe 76, 78 to a corresponding cam follower surface 130, 132 are transferred by the support structure 140 to the printhead housing main body 62 so as to cause the main body 62 to move relative to the rigid structural members 65 and 66 and the frame portion 120.

In the illustrated embodiment, each of the first and second cam lobes 76, 78 extends through an angle of about 180 degrees. Further, a radius $R_1$ on the first cam lobe 76, as defined from a central axis 74E of the camshaft 74 to the outer circumference 76A of the cam lobe 76, continuously increases from a start or home position 76B to an end position 76C, see FIG. 8A. For example, the radius $R_{1H}$ at the home position 76B may equal 5.84 mm, while the radius $R_{1E}$ at the end position 76C may equal 7.32 mm, resulting in a cam rise or increase in radius $R_1$ from the home position 76B to the end position 76C equal to 1.48 mm. A radius $R_2$ on the second cam lobe 78, as defined from the central axis 74E of the camshaft 74 to the outer circumference 78A of the cam lobe, continuously increases from a start or home position 78B to an end position 78C. For example, the radius $R_{2H}$ at the home position may equal 6.3 mm, while the radius $R_{2E}$ at the end position 78C may equal 7.78 mm, resulting in a cam rise or increase in radius $R_2$ from the home position 78B to the end position 78C equal to 1.48 mm. Alternatively, the cam lobes 76 and 78 may have shapes other than an arc shape and may extend through an angle other than 180 degrees such as one which falls within the range of from about 10 degrees to about 180 degrees.

Prior to being mounted to the printer frame 120, the printhead 20A is assembled such that the skew correction mechanism 70 is mounted to the printhead housing 60. As noted above, when mounting the printhead 20A to the frame portion 120, the lower portion 62A of the main body 62 is inserted through the frame portion center opening 120B and the mounting features 65A, 66A and 66B are positioned so as to rest on the frame portion planar upper surface 120A. The mounting features 65A, 66A and 66B are located so as to be positioned directly over the tapped holes 120C-120E provided in the frame portion 120. The fasteners 68A-68C are inserted through the enlarged mounting slots 67 in the mounting features 65A, 66A, 66B and lightly threaded into the printer frame tapped holes 120C-120E so as to fasten the printhead housing 60 to the frame portion 120 yet allow some movement of the printhead 20A relative to the frame portion 120.

It is contemplated that a fixture (not shown) may be mounted in V-blocks within the printer frame directly below the printhead 20A. At a later assembly operation after the fixture is removed from the V-blocks, the V-blocks receive a corresponding PC drum. The fixture may have sensors located so as to sense the process direction position of the scanning laser beam 21A at first and second points 122A and 122B along the scan path 121A, see FIG. 2. The first and second points 122A and 122B may correspond to end points of a scan line of pixels or Pels, i.e., modulated data, which normally would be written on a PC drum. An operator may then move the printhead 20A so as to adjust the location of the scanning laser beam 21A in the process direction. That is, the printhead 20A is moved relative to the frame portion 120 to the extend permitted by the size of the mounting feature slots 67 until the scanning laser beam 21A scans across a desired location on the fixture, e.g., corresponding to a desired straight line along a PC drum. It is noted that this first adjustment operation allows skew of the scanning laser beam 21A to be corrected, i.e., the scan path 121A may be rotated about either the first scan path point 122A or the second scan path point 122B. It is further noted that this first adjustment operation is not limited to making skew adjustments. In addition, the entire scan path 121A may be adjusted in the process direction by moving the entire printhead housing 60 in the process direction, again to the extent permitted by the mounting feature slots 67 and the fasteners 68A-68C in those slots 67. After the first adjustment operation has been completed, the fasteners 68A-68C are further tightened to rigidly secure the printhead housing 60 to the frame portion 120 such that the first and second rigid structural member 65 and 66 do not rotate or otherwise move relative to the frame portion 120. It is noted that the first adjustment operation is preferably effected for each of the four print the ads 20A-20D.

First and second pry openings 65E and 66C are provided in the first and second structural members 65 and 66, see FIG. 3. The pry openings 65E and 66C are positioned over first and second openings (only the second opening 120F is shown in FIG. 3A) in the frame portion 120. A pry tool such as a screwdriver may be inserted in a pry opening and a corresponding opening in the frame portion 120 so as to move the printhead housing 60 relative to the frame portion 120.

A slight amount of skew may be imparted to the printhead housing 60 during the tightening of the fasteners 68A-68C. Further, there may be inaccuracies associated with the V-blocks that receive the fixture due to V-block tolerances such that a slight amount of printhead housing skew may be imparted to the housing 60 during the first adjustment operation. A second adjustment operation may be effected via the skew adjustment mechanism 70 so as to reduce or substantially eliminate small magnitudes of laser beam skew.

In the illustrated embodiment, the second skew adjustment is effected for three printheads relative to a reference, fourth printhead, such as one of the printheads 20B-20D. As noted above, the reference printhead may not be provided with a skew correction mechanism 70. Even if the reference printhead has a small amount of skew associated with it due to adjustments made during the first adjustment operation, the remaining three printheads are adjusted to eliminate skew resulting from inaccuracies associated with their corresponding V-blocks and the first adjustment operation, i.e., occurring when the fasteners 68A-68C are tightened for those three printheads. It is also contemplated that the skew of all four printheads may be adjusted relative to an ideal scan line. In such an embodiment, all four printheads 20A-20D would be provided with a skew correction mechanism 70.

Preferably, the second adjustment operation occurs after the printer 10 has been fully assembled and is operational. To sense the direction and magnitude of the skew relative to a scan line generated by the reference printhead, a printed test sheet may be generated. A printer processor generates test patterns which, when printed, define the printed test page. The magnitude and direction of the skew relative to a scan line generated by the reference printhead is determined either via a visual inspection of the printed test sheets or by performing image analysis of the test sheets using a scanner and a computer. Alternatively, one or more sensors may be provided in the printer 10 to sense the magnitude and direction of the skew relative to a scan line generated by the reference printhead.

Once the magnitude and direction of the laser beam skew relative to a scan line generated by the reference printhead has been determined, an operator rotates the detent wheel 80 in a first or a second direction causing one of the cam lobes 76 and 78 to apply a force to a corresponding cam follower surface 130, 132 to effect rotation of the first section 62B of the printhead housing main body 62 about a virtual pivot point 200, see FIG. 2. Hence, the main body 62 moves relative to the rigid structural members 65 and 66 and the frame portion 120. Rotation of the detent wheel 80 in a clockwise direction, as viewed in FIG. 8, causes the first cam lobe 76 to apply a force in a direction of arrow 202 against the first cam follower surface 130. Due to the geometry of the second cam lobe 78 and the second cam follower surface 132 and because the second cam lobe 78 is axially spaced from the first cam follower surface 130, when the first cam lobe 76 applies a force in the direction of arrow 202 against the first surface 130, the second cam lobe 78 does not engage the first or the second cam follower surface 130 and 132. Rotation of the detent wheel 80 in a counter-clockwise direction, as view in FIG. 8, causes the second cam lobe 78 to apply a force in a direction of arrow 204 against the second cam follower surface 132. Due to the geometry of the first cam lobe 76 and the first cam follower surface 130 and because the first cam lobe 76 is axially spaced from the second cam follower surface 132, when the second cam lobe 78 applies a force in the direction of arrow 204 against the second surface 132, the first cam lobe 76 does not substantially engage the first or the second cam follower surface 130 and 132.

Correction resolution may equal cam rise, as defined above, divided by the number of teeth 80B provided on the detent wheel 80 corresponding the angular extent or total cam rotation angle of the corresponding cam lobe 76, 78. For example, each cam lobe 76, 78 extends through an angle of about 180 degrees, i.e., defines an arc of about 180 degrees. If the detent wheel 80 is provided with total of 78 teeth 80B, the number of teeth 80B provided on the detent wheel 80 corresponding the angular extent of each cam lobe 76, 78 is equal to 78/2 teeth or 39 teeth. Resolution may be increased or decreased by varying the number of teeth 80B provided on the detent wheel 80 and/or by varying the cam rise on each cam lobe 76, 78.

Because the skew correction mechanism 70 is mounted solely to the printhead housing 60 and is not mounted to the frame portion 120, the mechanism 70 is substantially centered relative to the printhead housing main body 62 after the first adjustment operation has been completed. Hence, the range of possible movement of the first section 62B of the printhead housing main body 62 at the conclusion of the first adjustment operation is substantially the same in a first direction, generally parallel to force arrow 202 in FIG. 8, as it is in a second direction, generally parallel to force arrow 204. It is also noted that reaction forces generated by the first and second cam follower surfaces 130 and 132 against the first and second cam lobes 76 and 78 pass centrally through the camshaft 74 and, hence, do not create any moments which might result in unwanted rotation of the camshaft 74.

The printhead housing is preferably formed from a material having a low coefficient of thermal expansion, such as GE LNP Noryl CN5258.

Having described the invention in detail and by reference to a preferred embodiment thereof, it will be apparent that modifications and variations are possible without departing from the scope of the invention defined in the appended claims.

What is claimed is:

1. An imaging apparatus comprising a frame having a portion upon which a printhead is adapted to be mounted, said printhead comprising:

a housing including a main body, at least one flexible mounting beam extending from said main body, and at least one structural member coupled to said at least one flexible mounting beam; and a skew correction mechanism mounted solely to said printhead housing, said skew correction mechanism including an adjustment member capable of engaging at least one surface on said printhead housing main body so as to adjust the position of said printhead housing main body relative to said frame portion.

2. An imaging apparatus as set forth in claim 1, wherein said at least one surface on said printhead housing main body comprises first and second surfaces on said printhead housing main body such that said adjustment member is capable of engaging said first and second surfaces on said printhead housing main body.

3. An imaging apparatus as set forth in claim 2, wherein said at least one flexible mounting beam comprises at least first and second flexible mounting beams extending from said main body and wherein said at least one structural member comprises a first substantially rigid structural member coupled to said first and second flexible mounting beams.

4. An imaging apparatus as set forth in claim 3, wherein said at least one flexible mounting beam further comprises third and fourth flexible mounting beams extending from said main body and wherein said at least one structural member further comprises a second substantially rigid structural member coupled to said third and fourth flexible mounting beams.

5. An imaging apparatus as set forth in claim 4, wherein each of said first and second substantially rigid structural members comprises at least one mounting feature for fixing said printhead housing to said frame portion, said mounting feature having an enlarged mounting slot through which a fastener extends such that said fastener may be lightly secured to said frame portion to allow said printhead housing to be subsequently adjusted relative to said frame portion.

6. An imaging apparatus as set forth in claim 4, wherein said adjustment member of said skew correction mechanism comprises a camshaft and first and second cam lobes coupled to said camshaft, said first cam lobe being adapted to engage said first surface on said printhead housing main body and said second cam lobe being adapted to engage said second surface on said printhead housing main body.

7. An imaging apparatus as set forth in claim 6, wherein said first and second surfaces on said printhead housing main body are defined by first and second cam follower surfaces on said printhead housing main body.

8. An imaging apparatus as set forth in claim 6, wherein said first and second cam lobes are axially spaced apart along said camshaft.

9. An imaging apparatus as set forth in claim 8, wherein each of said first and second cam lobes extends through a maximum angle falling within a range of about 10 degrees to about 180 degrees.

10. An imaging apparatus as set forth in claim 6, wherein said skew correction mechanism further comprises a detent wheel coupled to said camshaft such that said camshaft rotates with said detent wheel.

11. An imaging apparatus as set forth in claim 10, wherein said skew correction mechanism further comprises a camshaft support mounted to said first substantially rigid structural member and including a pawl having an engagement member for engaging one of a plurality of recesses provided in said detent wheel.

12. An imaging apparatus as set forth in claim 11, wherein said skew correction mechanism further comprises a support on said first substantially rigid structural member for receiving an end portion of said camshaft.

13. An imaging apparatus comprising a frame having a portion upon which a printhead is adapted to be mounted, said printhead comprising:

a housing including a main body, at least first and second flexible mounting beams extending from said main body, and at least one structural member comprising a first substantially rigid structural member coupled to said first and second flexible mounting beams; and a skew correction mechanism associated with said printhead housing, said skew correction mechanism including an adjustment member capable of engaging first and second surfaces on said printhead housing main body so as to adjust the position of said printhead housing main body relative to said frame portion, said adjustment member comprising a camshaft and first and second cam lobes coupled to said camshaft, said first cam lobe being adapted to engage said first surface on said printhead housing main body and said second cam lobe being adapted to engage said second surface on said printhead housing main body.

14. An imaging apparatus as set forth in claim 13, wherein said first and second cam lobes are axially spaced apart along said camshaft.

15. An imaging apparatus as set forth in claim 13, wherein said skew correction mechanism further comprises a detent wheel coupled to said camshaft such that said camshaft rotates with said detent wheel.

16. An imaging apparatus as set forth in claim 15, wherein said skew correction mechanism further comprises a camshaft support mounted to said first substantially rigid structural member including a pawl having an engagement member for engaging one of a plurality of recesses provided in said detent wheel.

17. An imaging apparatus comprising a frame having a portion upon which a printhead is adapted to be mounted, said printhead comprising:

a housing including a main body, at least one flexible mounting beam extending from said main body, and at least one structural member coupled to said at least one flexible mounting beam; and a skew correction mechanism associated with said printhead housing, said skew correction mechanism including an adjustment member including first and second camming members capable of engaging first and second cam follower surfaces on said printhead housing main body so as to adjust the position of said printhead housing main body relative to said frame portion.

18. An imaging apparatus as set forth in claim 17, wherein said adjustment member of said skew correction mechanism comprises a camshaft and first and second cam lobes defined by said first and second camming members, said first and second cam lobes being spaced apart in an axial direction along said camshaft.

* * * * *